US008313359B2

(12) United States Patent
Saito

(10) Patent No.: US 8,313,359 B2
(45) Date of Patent: Nov. 20, 2012

(54) CHEMICAL MECHANICAL POLISHING APPARATUS

(75) Inventor: Toshiya Saito, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 345 days.

(21) Appl. No.: 12/700,159

(22) Filed: Feb. 4, 2010

(65) Prior Publication Data

US 2010/0197207 A1 Aug. 5, 2010

(30) Foreign Application Priority Data

Feb. 5, 2009 (JP) ..... 2009-024877

(51) Int. Cl.
*B24B 9/00* (2006.01)

(52) U.S. Cl. ..... 451/66; 451/56; 451/285; 451/287; 451/444

(58) Field of Classification Search ..... 451/56, 451/66, 285–289, 444; 15/77, 88.1, 88.2, 15/88.3, 246.5, 256.5
See application file for complete search history.

(56) References Cited

U.S. PATENT DOCUMENTS

| | | | | | |
|---|---|---|---|---|---|
| 1,366,306 | A | * | 1/1921 | Wick | 4/628 |
| 1,689,277 | A | * | 10/1928 | Burns | 210/408 |
| 3,983,888 | A | * | 10/1976 | Edwards | 134/9 |
| 4,516,357 | A | * | 5/1985 | Gach | 451/231 |
| 5,161,669 | A | * | 11/1992 | Gibson, Jr. | 198/499 |
| 5,245,796 | A | * | 9/1993 | Miller et al. | 451/41 |
| 5,268,890 | A | * | 12/1993 | Colescott | 369/71 |
| 5,384,986 | A | * | 1/1995 | Hirose et al. | 451/444 |
| 5,729,856 | A | * | 3/1998 | Jang et al. | 15/88.1 |
| 6,139,406 | A | * | 10/2000 | Kennedy et al. | 451/67 |
| 6,152,813 | A | * | 11/2000 | Suzuki | 451/443 |
| 6,227,956 | B1 | * | 5/2001 | Halley | 451/288 |
| 6,291,350 | B1 | * | 9/2001 | Hashimoto et al. | 438/692 |
| 6,325,698 | B1 | * | 12/2001 | Wada et al. | 451/8 |
| 6,361,413 | B1 | * | 3/2002 | Skrovan | 451/56 |
| 6,361,647 | B1 | * | 3/2002 | Halley | 156/345.1 |
| 6,364,749 | B1 | * | 4/2002 | Walker | 451/41 |
| 6,375,791 | B1 | * | 4/2002 | Chiesl et al. | 156/345.13 |
| 6,475,293 | B1 | * | 11/2002 | Moinpour et al. | 134/6 |
| 6,629,874 | B1 | * | 10/2003 | Halley | 451/6 |
| 6,776,693 | B2 | * | 8/2004 | Duboust et al. | 451/41 |
| 7,910,157 | B2 | * | 3/2011 | Terada et al. | 427/99.3 |
| 2006/0030157 | A1 | * | 2/2006 | Ivanov | 438/692 |
| 2008/0020682 | A1 | * | 1/2008 | Jia et al. | 451/56 |
| 2010/0273401 | A1 | * | 10/2010 | Shiratani et al. | 451/56 |

FOREIGN PATENT DOCUMENTS

JP 2006-080138 3/2006

* cited by examiner

*Primary Examiner* — George Nguyen
(74) *Attorney, Agent, or Firm* — Young & Thompson

(57) ABSTRACT

A chemical mechanical polishing apparatus includes a container, a platen, first and second brushes, a polishing pad, a carrier, and a slurry supplier. The container has a bottom wall and a side wall. The side wall has an inwardly-extending upper portion. The platen is supported over the bottom wall. The platen is positioned lower than the inwardly-extending upper portion. The first brush brushes the side wall. The first brush is fixed to a side surface of the platen. The second brush brushes a side surface of the platen. The second brush is fixed to the bottom wall. The polishing pad is attached to the platen. The carrier presses a workpiece to be polished against the polishing pad. The slurry supplier supplies a slurry onto the polishing pad.

20 Claims, 5 Drawing Sheets

CHEMICAL MECHANICAL POLISHING APPARATUS

BACKGROUND OF THE INVENTION

1. Field of the Invention

The present invention relates to a chemical mechanical polishing apparatus.

Priority is claimed on Japanese Patent Application No. 2009-024877, filed Feb. 5, 2009, the content of which is incorporated herein by reference.

2. Description of the Related Art

As well known, a CMP (Chemical Mechanical Polishing) machine is used for polishing a workpiece, such as a surface of a semiconductor wafer that is required to be flat. For example, Japanese Patent Laid-Open Publication No. 2006-080138 discloses a conventional CMP apparatus.

FIGS. 6 and 7 illustrate an example of a conventional CMP apparatus 1. FIGS. 6 and 7 are cross-sectional and plane views illustrating the CMP apparatus 1, respectively.

As shown in FIGS. 6 and 7, the conventional CMP apparatus 1 schematically includes: a rotatable circular platen 3 that is placed in a waste container 2 and has a predetermined thickness; a polishing pad 4 attached onto the platen 3; a carrier 6 that presses a workpiece 5 to be polished against the polishing pad 4; a slurry supplier 7 that supplies a slurry onto the polishing pad 4; and a dresser 8 that planarizes the polishing pad 4.

The waste container 2 has an outlet 9 on a bottom surface 2*a* thereof. A side wall 2*b* of the waste container 2 is perpendicular to a bottom wall 2*a* of the waste container 2. The outlet 9 is provided for removing slurry which is dripped on the polishing pad 4 and then is dropped on the waste container 2.

The platen 3 has a predetermined thickness and is circular in plane view (i.e., when viewed in a direction perpendicular to upper and bottom surfaces of the platen 3). The platen 3 is rotatable around a circumference thereof using an apparatus (not shown). The polishing pad 4 is attached onto the platen 3.

The polishing pad 4 polishes the workpiece 5 by grinding against the workpiece 5. The polishing pad 4 may be made of any material, such as a foamable resin, a non-foamable resin, or a nonwoven fabric, as long as the workpiece 5 can be polished.

The carrier 6 schematically includes a polishing head 11 and a retainer 12. The polishing head 11 is rotatable around a circumference thereof and is circular in plane view. The polishing head 11 can press the workpiece 5 held by the retainer 12 against the polishing pad 4.

The retainer 12 is disposed between the polishing head 11 and the polishing pad 4 to hold the workpiece 5. Specifically, the retainer 12 is a ring-shaped board having a predetermined thickness and has space 13 in the center thereof. A compression chamber 15 defined by a membrane 14 is provided in the space 13. The retainer 12 holds the workpiece 5 under the compression chamber 15 in the space 13.

When the compression chamber 15 is compressed, the membrane 14 downwardly expands. The membrane 14 is made of, for example, neoprene rubber. A compression unit 16 connects to a duct different from one connected to the compression chamber 15, and is used for adjusting expansion of the membrane 14.

The slurry supplier 7 drips, in the center region of the polishing pad 4, slurry (not shown) that is an abrasive including grains for polishing the workpiece 5 on the polishing pad 4. A slurry can be selected according to the workpiece 5. For example, a slurry including $SiO_2$, $Al_2O_3$, $CeO_2$, and the like as grains can be used.

The dresser 8 is provided for maintaining the planarity and polishing efficiency of the polishing pad 4. Therefore, the dresser 8 is not limited to a specific configuration as long as the dresser 8 can planarize the polishing pad 4 from the periphery to the center thereof.

Hereinafter, a method of polishing the workpiece 5 using the CMP apparatus 1 is explained.

Firstly, the workpiece 5 to be polished is held by the retainer 12 with a target surface of the workpiece 5 downwardly facing. Then, the polishing head 11 is moved above the polishing pad 4 while the workpiece 5 is held.

Then, the polishing pad 4 and the polishing head 11 are rotated, and the compression chamber 15 is compressed by injecting air thereinto, so that the membrane 14 expands and therefore the workpiece 5 is pressed against the polishing pad 4.

Then, the slurry supplier 7 supplies a slurry onto the polishing pad 4. Thus, the polishing pad 4 is grinded against the workpiece 5, thereby polishing the workpiece 5.

When the workpiece 5 is polished by the conventional CMP apparatus 1, the certain number of workpieces 5 are scratched. FIG. 4 is a graph illustrating the relationship between the rotation number of the platen 3 and the number of defective wafers when wafers are used as the workpieces 5.

As understood from FIG. 4, the number of defective wafers increases as the rotation number of the platen 3 increases, indicating that dried-and-solidified slurry drops on the polishing pad 4, thereby causing the workpiece 5 to be scratched.

In other words, the slurry dripped in the center region of the polishing pad 4 spreads over the surface of the polishing pad 4 and then escapes from the periphery of the polishing pad 4. Then, the slurry hits the side wall 2*b* of the waste container 2 due to centrifugal force generated by the rotating polishing pad 4, and is removed from the outlet 9.

When the slurry hits the side wall 2*b* of the waste container 2, a part of the slurry is dispersed in the air and attached onto a wall of a processing container of the CMP apparatus 1 (not shown) and surfaces of the polishing head 11, and then is dried and solidified in some cases.

Then, the dried-and-solidified slurry naturally drops, but a part of the slurry drops on the polishing pad 4. For this reason, foreign matters are present on the polishing pad 4, thereby causing the workpiece 5 to be scratched.

SUMMARY

In one embodiment, a chemical mechanical polishing apparatus includes a container having a bottom wall and a side wall, the side wall having an inwardly-extending upper portion.

In another embodiment, a chemical mechanical polishing apparatus includes a container, a platen, and a brush. The container has a bottom wall and a side wall. The platen is supported over the bottom wall. The platen is positioned lower than an upper portion of the side wall. The brush brushes the side wall. The brush is fixed to a side surface of the platen.

In still another embodiment, a chemical mechanical polishing apparatus includes a container, a platen, and a brush. The container has a bottom wall and a side wall. The platen is supported over the bottom wall. The platen is positioned lower than an upper portion of the side wall. The brush brushes a side surface of the platen. The brush is fixed to the bottom wall.

Accordingly, even if a slurry hits the side wall of the container, the flow velocity of the slurry decreases since the side wall has the inwardly-extending upper portion, thereby preventing the slurry from being dispersed in the air and therefore enabling the slurry to be removed from the outlet.

Consequently, the dried slurry does not drop on the polishing pad, thereby preventing the polishing pad and the workpiece from being scratched.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE PREFERRED EMBODIMENTS

The present invention will now be described herein with reference to illustrative embodiments. The accompanying drawings explain a semiconductor device. The size, the thickness, and the like of each illustrated portion might be different from those of each portion of an actual CMP apparatus.

Those skilled in the art will recognize that many alternative embodiments can be accomplished using the teachings of the present invention and that the present invention is not limited to the embodiments illustrated herein for explanatory purposes.

Figure 1:
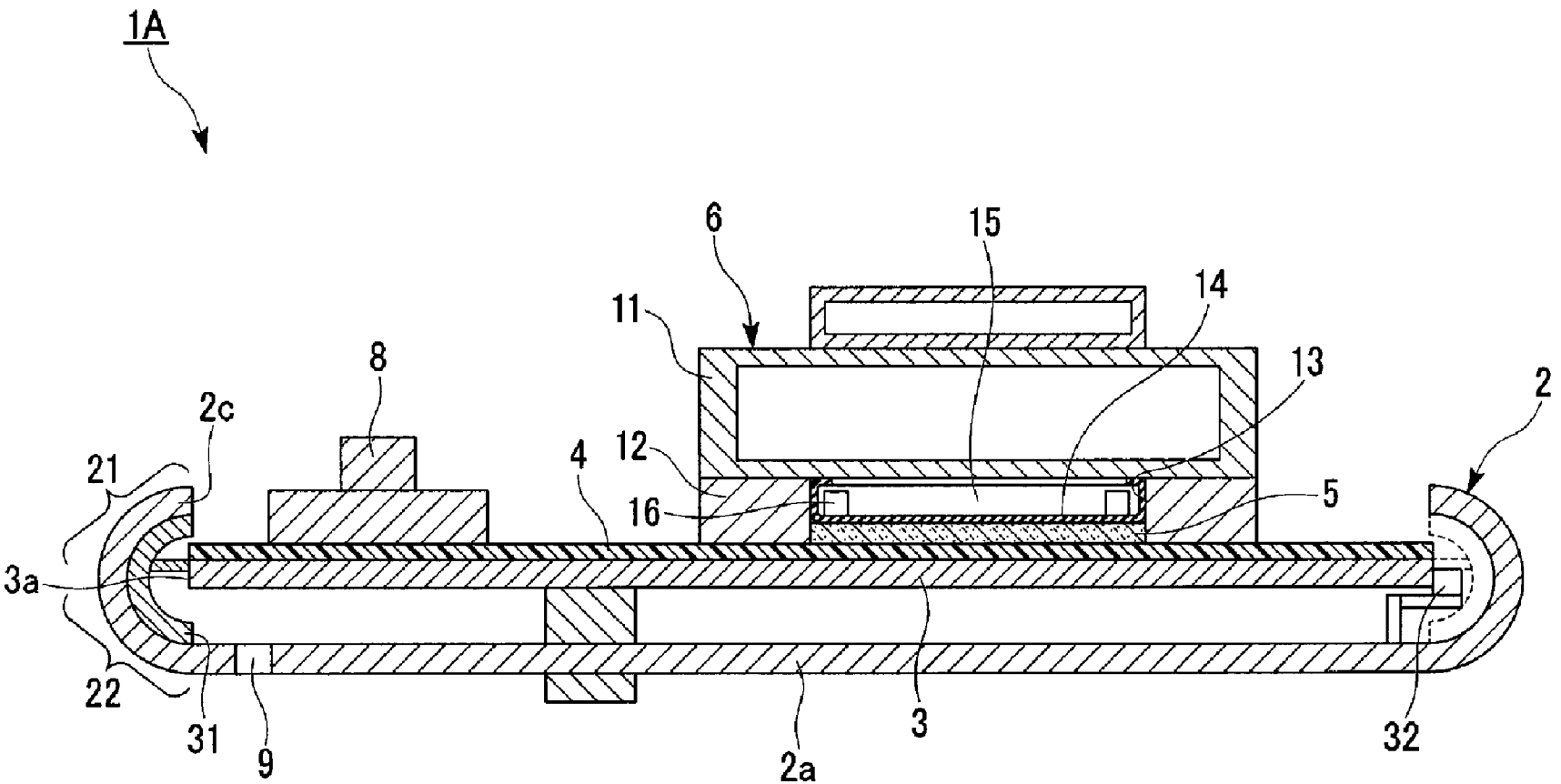
FIGS. 1 and 2 are cross-sectional and plane views illustrating a CMP apparatus according to a first embodiment of the present invention, respectively.
Figure 2:
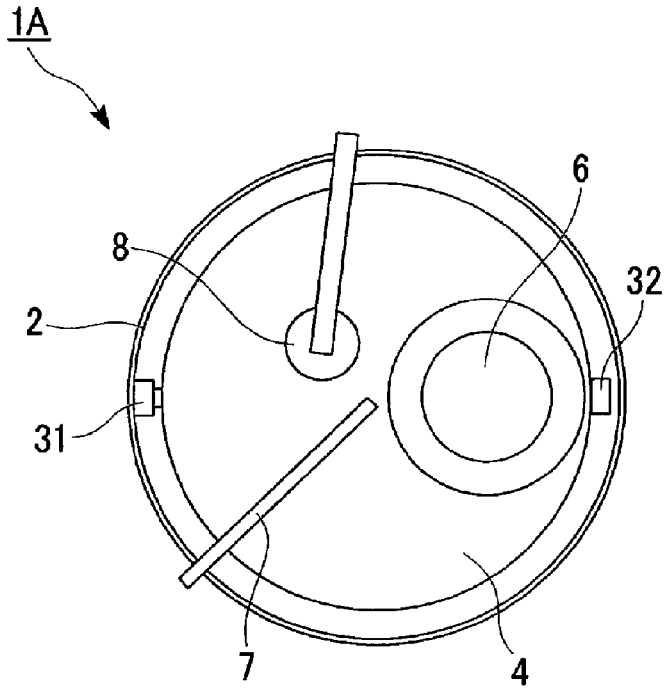
Figure 3A:
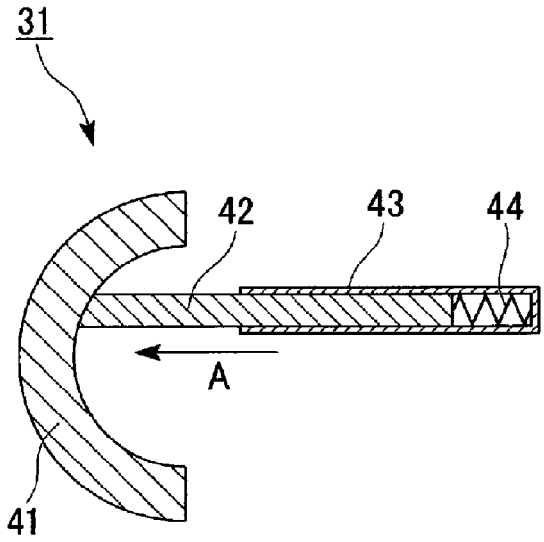
FIG. 3A is a cross-sectional view illustrating a container cleaning brush of the CMP apparatus according to the first embodiment.
Figure 3B:
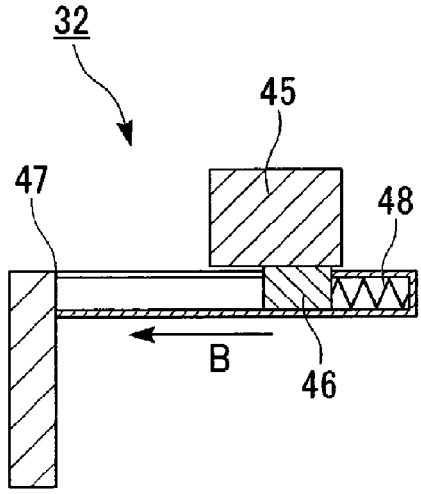
FIG. 3B is a cross-sectional view illustrating a platen cleaning brush of the CMP apparatus according to the first embodiment.
Figure 4:
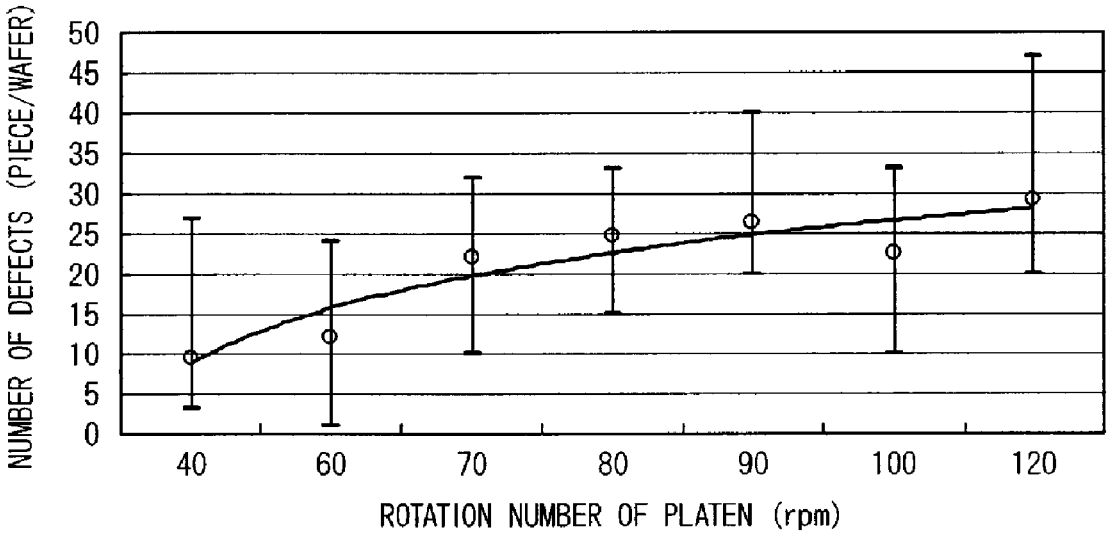
FIG. 4 is a graph illustrating the relationship between the rotation number of the platen and the number of defective wafers when wafers are used as workpieces to be polished.

FIGS. 1 and 2 are cross-sectional and plane views illustrating a CMP apparatus 1A according to a first embodiment of the present invention, respectively. FIG. 3A is a cross-sectional view illustrating a container cleaning brush 31 of the CMP apparatus 1A. FIG. 3B is a cross-sectional view illustrating a platen cleaning brush 32 of the CMP apparatus.

The CMP apparatus 1A includes: a waste container 2; a circular platen 3 that is rotatable around a circumference thereof and has a predetermined thickness; a polishing pad 4 attached to the platen 3; a carrier 6 that presses a workpiece 5 against the polishing pad 4; a slurry supplier 7 that supplies a slurry onto the polishing pad 4; a dresser 8 that planarizes the polishing pad 4; a container cleaning brush 31 on a side surface of the platen 3; and a platen cleaning brush 32 on a bottom wall 2*a* of the waste container 2.

Explanations of the like elements between the related art and the first embodiment are omitted here.

As shown in FIGS. 1 and 2, a side wall 2*c* of the waste container 2 is outwardly curved (i.e., convex outward). Specifically, the side wall 2*c* of the waste container 2 includes an upper curved portion 21 and a lower curved portion 22. The platen 3 is supported over the bottom wall 2*a* of the waste container 2 and is positioned lower than the upper curved portion 21. Accordingly, the slurry escaping due to centrifugal force generated by the rotating polishing pad 4 hits the upper curved portion 21.

The side wall 2*c* is configured so that the escaping slurry does not hit the lower curved portion 22. This is because if the escaping slurry is allowed to hit the lower curved portion 22, a part of the slurry bounces back onto the upper curved portion 21, drops, hits slurry newly escaping from the polishing pad 4, and then a part of the hit slurry might be dispersed in the air.

The container cleaning brush 31 is provided on a side surface 3*a* of the platen 3. The container cleaning brush 31 can be in contact with the side wall 2*c* of the waste container 2.

Specifically, as shown in FIG. 3A, the container cleaning brush 31 includes: a brush 41; a movable portion 42 having one end fixed to the brush 41; a case 43 partially housing the movable portion 42, a right end of the case 43 being fixed onto the side surface 3*a* of the platen 3; and a spring 44 connecting a right end of the case 44 and a right end of the movable portion 43.

In other words, the spring 44 can press the brush 41 in the direction indicated by an arrow A shown in FIG. 3A. The brush 41 is outwardly curved (i.e., convex outward) correspondingly to the curved side wall 2*c* of the waste container 2. The brush 41 is preferably made of an elastically deformable material, such as PVA (Polyvinyl Alcohol).

The platen cleaning brush 32 provided on the waste container 2 can be in contact with the side surface of the platen 3.

Specifically, as shown in FIG. 3B, the platen cleaning brush 32 includes: a brush 45; a movable portion 46, an upper portion of which is connected to the brush 45; a case 47 for partially housing the movable portion 46; a spring 48 connecting a right end of the movable portion 46 and a right end of the case 47.

In other words, the spring 48 can press the brush 45 in the direction indicated by an arrow B shown in FIG. 3B. The brush 45 is preferably made of an elastically deformable material, such as PVA (Polyvinyl Alcohol).

As shown in FIG. 1, the brush 45 of the platen cleaning brush 32 is positioned lower than the movable portion 42 of the container cleaning brush 31 so that the container cleaning brush 31 rotating with the platen 3 does not hit the platen cleaning brush 32.

Hereinafter, a method of polishing the workpiece 5 using the CMP apparatus 1 is explained with reference to FIGS. 1 and 2.

Firstly, the workpiece 5 to be polished is held by the retainer 12 with a target surface of the workpiece 5 downwardly facing. Then, the polishing head 11 is moved above the polishing pad 4 while the workpiece 5 is held.

Then, the polishing pad 4 and the polishing head 11 are rotated, and the compression chamber 15 is compressed by injecting air therein, so that the membrane 14 expands and therefore the workpiece 5 is pressed against the polishing pad 4.

Then, the slurry supplier 7 supplies slurry in the center region of the polishing pad 4. Thus, the polishing pad 4 is grinded against the workpiece 5, thereby polishing the workpiece 5.

In this case, the slurry escaping from the periphery of the polishing pad 4 due to centrifugal force generated by the rotating polishing pad 4 hits the upper curved portion 21 of the side wall 2*c* of the waste container 2.

Consequently, the velocity of the hit slurry decreases since the upper curved portion 21 is outwardly curved (i.e., convex outward). Then, the slurry passes along the side wall 2*c* and then is removed from the outlet 9 of the waste container 2.

If the slurry upwardly bounces back, the slurry is guided along the upper curved portion 21. For this reason, the velocity of the slurry decreases until reaching the top of the upper curved portion 21, thereby preventing the slurry from being dispersed in the air.

Accordingly, the slurry is prevented from being dispersed in the air, and therefore the workpiece 5 is prevented from being scratched which is caused by the dried-and-solidified slurry dropped on the polishing pad 4.

Additionally, the container cleaning brush 31 rotates together with the platen 3, and cleans the inner side wall 2*c* of the waste container 2, thereby removing the slurry attached on the inner side wall 2*c* before the slurry is dried and solidified.

Similarly, the platen cleaning brush 32 is in contact with the side surface 3*a* of the rotating platen 3, and cleans the side surface 3*a* of the platen 3, thereby removing the slurry attached on the side surface 3*a* before the slurry is dried and solidified.

Thus, the slurry is further prevented from being dispersed in the air, thereby preventing the workpiece 5 from being scratched which is caused by the dried and solidified slurry dropped on the polishing pad 4.

Figure 5:
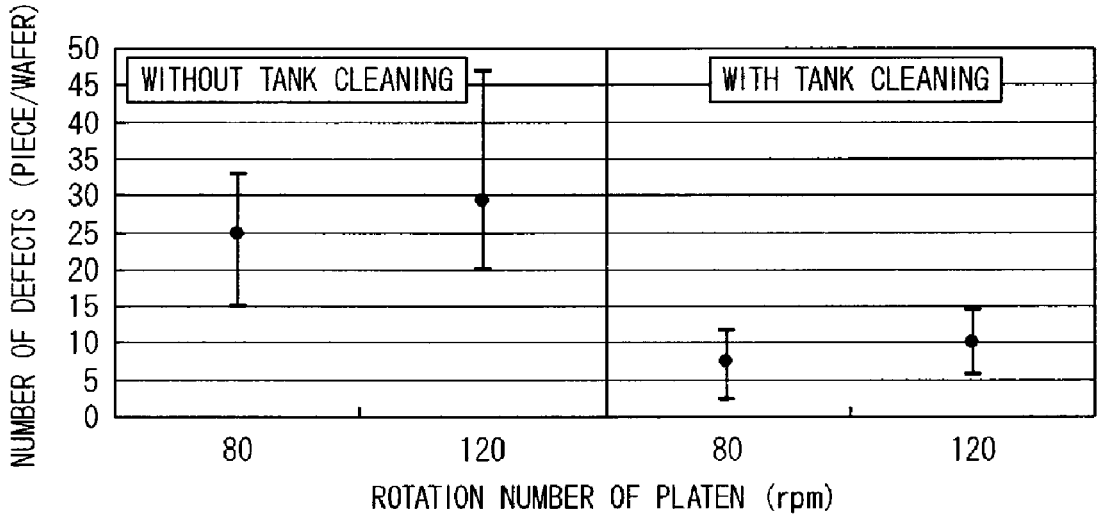
FIG. 5 is a graph illustrating the number of defective wafers before and after cleaning a waste container when wafers are used as workpieces to be polished.
Figure 6:
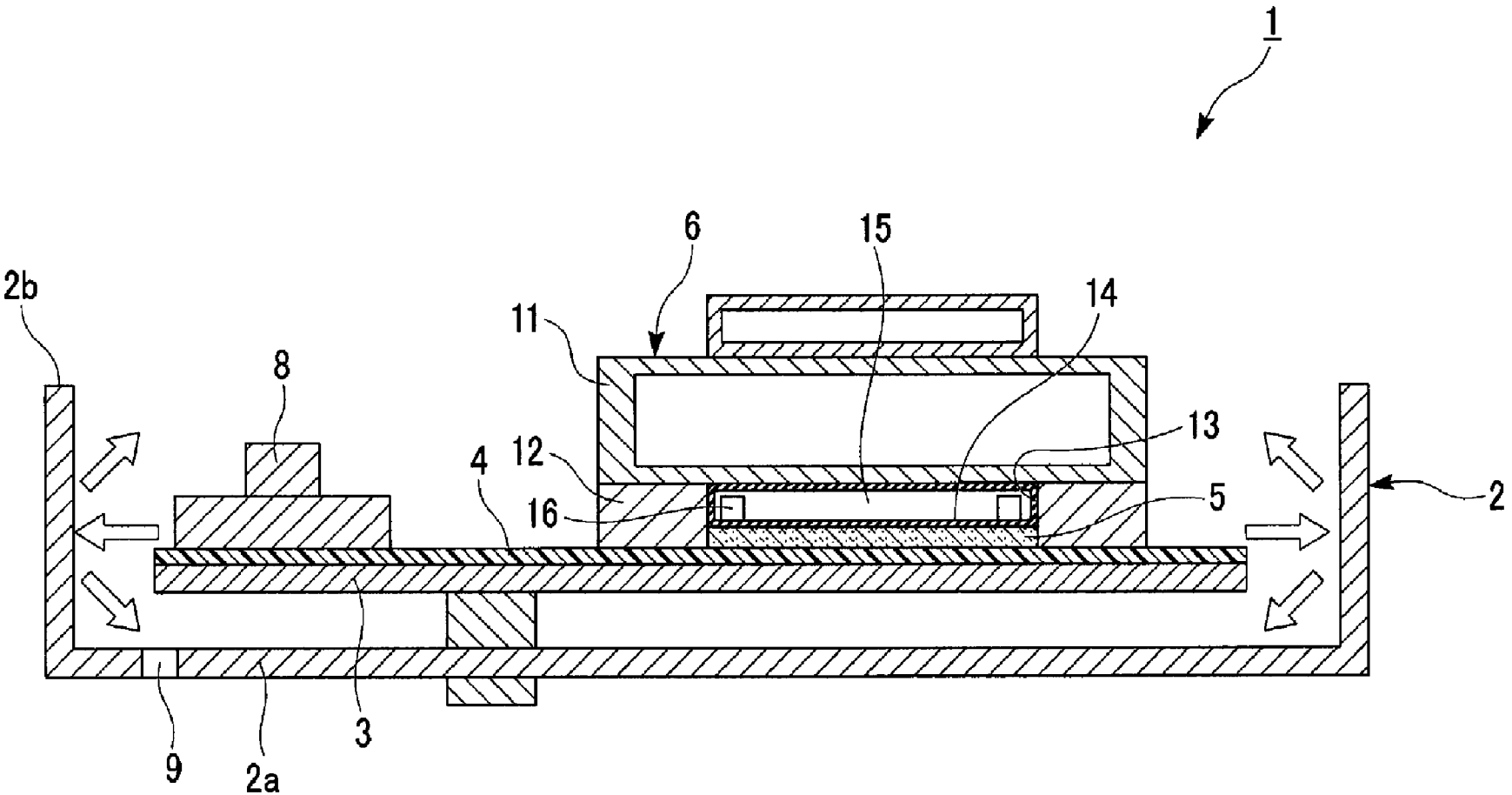
FIG. 6 RELATED ART
FIGS. 6 and 7 are cross-sectional and plane views illustrating a conventional CMP apparatus, respectively.
Figure 7:
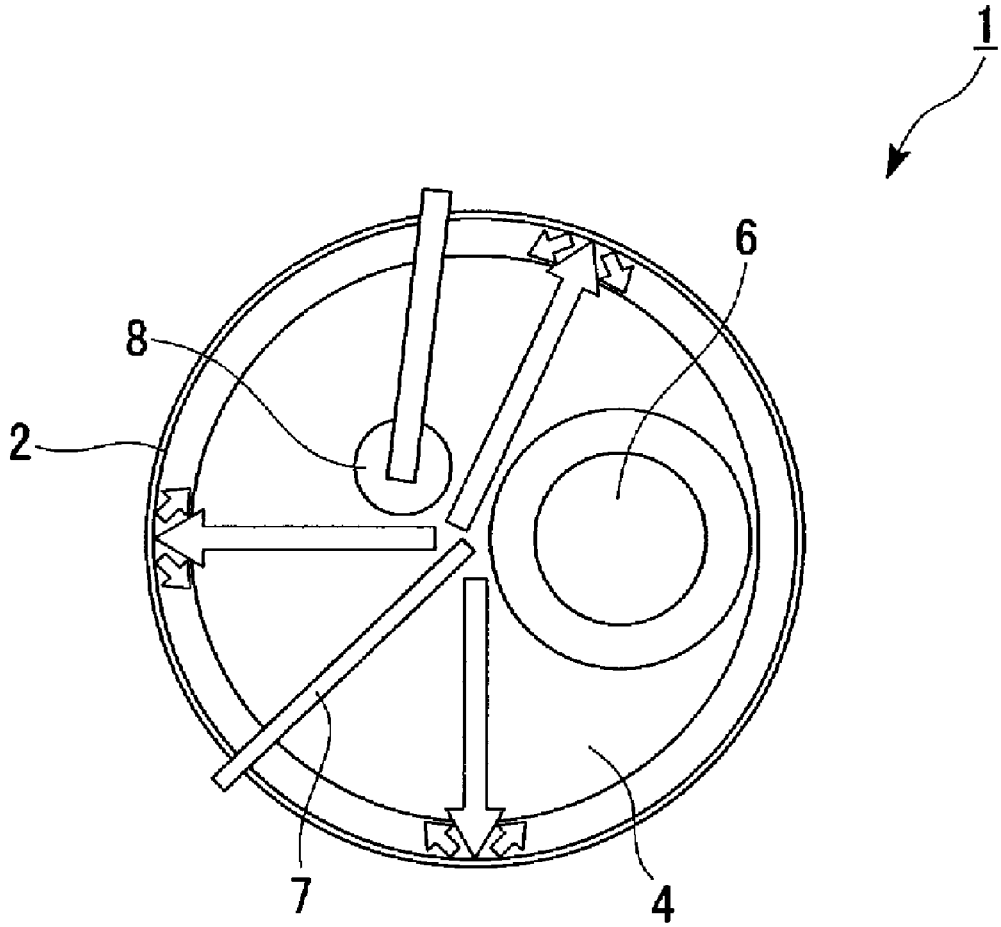
FIG. 7 RELATED ART

FIG. 5 illustrates the number of defective wafers before and after cleaning the waste container 2 when wafers are used as the workpieces 5.

As understood from FIG. 5, the number of defective wafers decreases after the cleaning regardless of the rotation number of the platen 3. Thus, the slurry remaining on the inner side wall 2*c* of the waste container 2 and the side surface 3*a* of the platen 3 is cleaned out, thereby preventing the slurry from dropping onto the polishing pad 4.

It is apparent that the present invention is not limited to the above embodiments, but may be modified and changed without departing from the scope and spirit of the invention.

For example, air in the waste container 2 is exhausted from the bottom of the waste container 2, thereby removing the dried-and-solidified slurry from the waste container 2 without the slurry being dispersed in the air.

Additionally, the shape of the side wall 2*c* of the waste container 2 is not limited to the outwardly convex shape shown in FIG. 1 as long as the side wall 2*c* has an inwardly-extending upper portion to prevent escaping slurry from being dispersed in the air. In this case, the inwardly-extending upper portion is, in cross-sectional view, inside a middle portion of the side wall 2 positioned at substantially the same level as the platen 3.

The present invention is widely applicable to manufacturing industries requiring polishing workpieces, such as semiconductor wafers, by using a CMP apparatus.

What is claimed is:

1. A chemical mechanical polishing apparatus comprising:
- a container having a bottom wall and a side wall, the side wall having an inwardly-extending upper portion; and
- a platen supported over the bottom wall,
- the side wall has a middle portion positioned at substantially the same level as the platen, and
- a distance between the inwardly-extending upper portion and the platen is smaller than a distance between the middle portion and the platen.

2. The chemical mechanical polishing apparatus according to claim 1, wherein
- the inwardly-extending upper portion is inside the middle portion in cross-sectional view.

3. The chemical mechanical polishing apparatus according to claim 1, further comprising:
- a first brush that brushes the side wall, the first brush being fixed to a side surface of the platen.

4. The chemical mechanical polishing apparatus according to claim 1, further comprising:
- a second brush that brushes a side surface of the platen, the second brush being fixed to the bottom wall.

5. The chemical mechanical polishing apparatus according to claim 1, further comprising:
- a first brush that brushes the side wall, the first brush being fixed to a side surface of the platen; and
- a second brush that brushes the side surface, the second brush being fixed to the bottom wall.

6. The chemical mechanical polishing apparatus according to claim 1, further comprising:
- a polishing pad attached to the platen;
- a carrier that presses a workpiece to be polished against the polishing pad; and
- a slurry supplier that supplies a slurry onto the polishing pad.

7. The chemical mechanical polishing apparatus according to claim 1, wherein the side wall has an outwardly convex shape in vertical cross-sectional view.

8. The chemical mechanical polishing apparatus according to claim 3, wherein the side wall and the first brush have an outwardly convex shape so as to contact each other in vertical cross-sectional view.

9. The chemical mechanical polishing apparatus according to claim 3, wherein
- the first brush comprises:
- a first portion having first and second ends, the first end being fixed to the side surface; and
- a first brush portion fixed to the second end, the first brush portion being pressed by the first portion against the side wall.

10. The chemical mechanical polishing apparatus according to claim 4, wherein
- the second brush comprises:
- a second portion vertically extending from the bottom wall;
- a third portion horizontally extending from the second portion; and
- a second brush portion attached to the third portion, the second brush portion being pressed by the third portion against the side surface.

11. The chemical mechanical polishing apparatus according to claim 5, wherein
- the first brush comprises:
- a first portion having first and second ends, the first end being fixed to the side surface; and
- a first brush portion fixed to the second end, the first brush portion being pressed by the first portion against the side wall, and
- the second brush comprises:
- a second portion vertically extending from the bottom wall;
- a third portion horizontally extending from the second portion; and
- a second brush portion attached to the third portion, the second brush portion being pressed by the third portion against the side surface, and the second brush portion being positioned lower than the first portion.

12. The chemical mechanical polishing apparatus according to claim 1, wherein a distance between an end of the inwardly-extending upper portion and the platen is smaller than the distance between the middle portion and the platen.

13. A chemical mechanical polishing apparatus comprising:

a container having a bottom wall and a side wall;

a platen supported over the bottom wall, the platen being positioned lower than an upper portion of the side wall; and a brush that brushes the side wall, the brush being fixed to a side surface of the platen.

14. The chemical mechanical polishing apparatus according to claim 13, wherein the upper portion is inwardly extending.

15. The chemical mechanical polishing apparatus according to claim 14, wherein the side wall and the brush have an outwardly convex shape so as to contact each other.

16. The chemical mechanical polishing apparatus according to claim 13, wherein the brush comprises:

a first portion having first and second ends, the first end being fixed to the side surface; and a brush portion fixed to the second end, the brush portion being pressed by the first portion against the side wall.

17. A chemical mechanical polishing apparatus comprising:

a container having a bottom wall and a side wall;

a platen supported over the bottom wall, the platen being positioned lower than an upper portion of the side wall; and a brush that brushes a side surface of the platen, the brush being fixed to the bottom wall.

18. The chemical mechanical polishing apparatus according to claim 17, wherein the upper portion is inwardly extending.

19. The chemical mechanical polishing apparatus according to claim 18, wherein the side wall has an outwardly convex shape in vertical cross-sectional view.

20. The chemical mechanical polishing apparatus according to claim 17, wherein the brush comprises:

a first portion vertically extending from the bottom wall;

a second portion horizontally extending from the first portion; and a brush portion attached to the second portion, the brush portion being pressed by the second portion against the side surface.

* * * * *